US008646976B2

(12) United States Patent
Stoik et al.

(10) Patent No.: US 8,646,976 B2
(45) Date of Patent: Feb. 11, 2014

(54) AUTO-CENTERING STRUCTURAL BEARING

(75) Inventors: Randy Stoik, Edmonton (CA); Van Hy Nguyen, Edmonton (CA)

(73) Assignee: Dreco Energy Services Ltd., Edmonton (CA)

( * ) Notice: Subject to any disclaimer, the term of this patent is extended or adjusted under 35 U.S.C. 154(b) by 53 days.

(21) Appl. No.: 13/307,502

(22) Filed: Nov. 30, 2011

(65) Prior Publication Data

US 2012/0219242 A1 Aug. 30, 2012

(30) Foreign Application Priority Data

Feb. 24, 2011 (CA) ..... 2732565

(51) Int. Cl.

| | |
|---|---|
| ***F16C 29/04*** | (2006.01) |
| ***F16C 41/00*** | (2006.01) |
| ***E04B 1/36*** | (2006.01) |
| ***E01D 19/04*** | (2006.01) |

(52) U.S. Cl.

CPC ..... *E04B 1/36* (2013.01); *E01D 19/043* (2013.01)

USPC ..... 384/36; 384/50; 384/54

(58) Field of Classification Search

USPC ..... 384/18, 36, 47–49, 50–51, 53–54, 418, 384/428; 310/12–15, 687; 318/38, 135; 405/195.1, 196, 201, 224

See application file for complete search history.

(56) References Cited

U.S. PATENT DOCUMENTS

| | | | | | |
|---|---|---|---|---|---|
| 3,291,541 | A | * | 12/1966 | Dellinger | 384/51 |
| 3,646,854 | A | * | 3/1972 | Bradley et al. | 92/98 R |
| 3,832,610 | A | * | 8/1974 | Shimizu et al. | 318/135 |
| 3,904,900 | A | * | 9/1975 | Shichida et al. | 310/12.05 |
| 4,288,177 | A | * | 9/1981 | Schoonmade | 405/196 |
| 4,667,139 | A | * | 5/1987 | Hirai et al. | 318/687 |
| 5,419,639 | A | * | 5/1995 | Hobbs et al. | 384/18 |
| 5,492,436 | A | * | 2/1996 | Suksumake | 405/201 |
| 5,699,621 | A | * | 12/1997 | Trumper et al. | 33/1 M |
| 5,760,500 | A | * | 6/1998 | Kondo et al. | 310/12.06 |
| 5,763,965 | A | * | 6/1998 | Bader | 310/12.06 |
| 5,812,310 | A | * | 9/1998 | Stewart et al. | 359/392 |
| 5,991,005 | A | * | 11/1999 | Horikawa et al. | 355/53 |
| 6,289,640 | B1 | | 9/2001 | Ueda et al. | |

(Continued)

FOREIGN PATENT DOCUMENTS

| | | |
|---|---|---|
| JP | 10184089 | 7/1998 |
| JP | 2000283221 | 10/2000 |
| JP | 2002030829 | 1/2002 |
| JP | 2002303058 | 10/2002 |

*Primary Examiner* — Marcus Charles
(74) *Attorney, Agent, or Firm* — Donald V. Tomkins

(57) ABSTRACT

An auto-centering structural bearing transfers vertical loads to a supporting structure while preventing transfer of lateral loads. In one embodiment, the structural bearing includes: parallel lower, middle, and upper bearing plates; a lower roller bed sandwiched between the lower and middle bearing plates and laterally displaceable in a first direction; an upper roller bed sandwiched between the middle and upper bearing plates and laterally displaceable in a second direction; lower centering means including springs compressible by lateral displacement of the middle bearing plate and the lower roller bed in the first direction; and upper centering means comprising springs compressible by lateral displacement of the upper bearing plate and the upper roller bed in the second direction. Upon removal of loads causing such lateral displacements, the springs will rebound to their unstressed states, thereby returning the displaced bearing plates and roller beds to their centered positions.

13 Claims, 17 Drawing Sheets

(56) References Cited

U.S. PATENT DOCUMENTS 6,971,795 B2 * 12/2005 Lee et al. ..... 384/36
7,172,203 B2 2/2007 Barnett
8,283,834 B2 * 10/2012 Matsubara et al. ..... 310/309
2002/0163257 A1 * 11/2002 Tsuboi et al. ..... 310/12
2007/0089267 A1 4/2007 Craddock

* cited by examiner

AUTO-CENTERING STRUCTURAL BEARING

FIELD OF THE INVENTION

The present invention relates in general to structural bearings for transferring large vertical loads to a supporting structure without physical connection between the bearing feet and the supporting structure. More particularly, the invention relates to a structural bearing that transfers little or no lateral load to the support structure in response to external lateral loads exerted upon the supported load.

BACKGROUND OF THE INVENTION

In various industrial contexts, it is commonly required to provide structural bearings for supporting vertical loads while preventing transfer of significant lateral forces to the supporting structure. Examples include structural bearings in bridges and larger buildings that must be able to carry large vertical loads without allowing transfer of lateral loads to the supporting structure due to wind loads, seismic loads, or expansion or contraction induced by temperature changes. As well, it is commonly desirable to prevent the development of lateral reactions against supporting structures and foundations that can otherwise develop in some structures due to inherent structural characteristics. For example, 'rigid frame' building structures can in some cases exert lateral forces against supporting structures or foundations, even under vertical loading alone.

In such situations, prevention of lateral load transfer to the supporting structure, or prevention of lateral reactions in rigid frame structures, is commonly achieved by allowing the bearings to move laterally relative to the supporting structure, with such lateral movement being facilitated by rollers of some type, or the bearings may be slide bearings using a low-friction material such as PTFE (polytetrafluoroethylene) .

In other scenarios, it is necessary to temporarily support large vertical loads on a supporting structure without transferring lateral loads, such as in conjunction with cantilevered mobile drilling rigs used to drill closely-spaced oil wells, particularly in extremely cold conditions. In such drilling operations, multiple wells are drilled at linear spacings of 10 or 12 feet, with the wellheads being disposed within a heated enclosure. The roof of the wellhead enclosure has hatches spaced to match the well spacing. Well drilling is carried out using a wheel-mounted or track-mounted mobile drilling rig having a cantilevered superstructure that carries a typically sliding rig floor. The mobile rig is positioned adjacent to the wellhead enclosure with the cantilevered superstructure extending over and beyond the wellhead enclosure. The mobile rig is movable parallel to the line of wells, such that it can be longitudinally aligned with each well location as required.

When the mobile rig is longitudinally aligned with a selected well, the free end of the cantilevered superstructure must be supported before the rig floor and mast section can be laterally positioned over the well and drilling operations commenced. For this purpose, a heavy girder is installed adjacent to the wellhead enclosure on the side opposite the mobile rig. The cantilevered superstructure is provided with two or more telescoping support legs that can be extended to bear upon the girder, without any mechanical connection or anchorage to the girder. When it is desired to move to a new well location, the support legs are retracted vertically away from the girder, and the mobile rig can then be relocated as required.

The girder is typically supported by spaced columns such that the top of the girder is at an elevation well above the roof of the wellhead enclosure, which may put the girder 25 or 30 feet above the ground. The vertical load exerted on the girder by each support leg during well-drilling operations can be in the range of 500,000 to 600,000 pounds. These large vertical loads create high frictional resistance across the contact interface between the support legs and the girder, such that large lateral loads exerted on the drilling rig structure by wind or seismic forces will react in part against the girder. This is undesirable not only because of the resultant torsional stresses induced in the girder, but also because of the resultant large bending moments induced in the structural columns supporting the girder (not to mention lateral loads and bending moments induced in the piles or other foundation systems supporting the columns).

For the foregoing reasons, there is a need for improved structural support bearings that will transfer large vertical loads to a supporting structure without allowing the transfer of significant lateral loads the supporting structure, but also without requiring lateral displacement at the contact interfaces between the support bearings and the supporting structure. The present invention is directed to this need.

BRIEF SUMMARY

The present disclosure addresses the foregoing need by providing a structural bearing apparatus for supporting vertical loads while preventing the transfer of significant lateral loading to the supporting structure without relative movement at the contact interface between the bearing and the supporting structure, and which will automatically return to a neutral or centered position upon removal of lateral loads acting on the supported vertical load. In one embodiment, the structural bearing incorporates:

- a lower bearing plate adapted to bear upon a supporting structure, with or without physical connection thereto;
- an upper bearing plate positioned above and parallel to the lower bearing plate, and incorporating means for mounting or connecting a supported vertical load (such as a component of a building structure);
- a first (or lower) load-bearing lateral displacement means disposed between the lower and upper bearing plates, whereby when the supported vertical load is subjected to lateral loading in a first direction:
  - the upper bearing plate will be laterally displaced, in the first direction, relative to the lower lateral displacement means;
  - the lower lateral displacement means will be laterally displaced, in the first direction, relative to the lower bearing plate; and
  - vertical loads applied to the upper bearing plate will be transferred through the lower lateral displacement means to the lower bearing plate and then to the supporting structure; and
- centering means, for returning the upper bearing plate and the lower lateral displacement means to their neutral positions upon removal of the applied lateral loads.

As used in this patent document, the term "neutral position" (or, alternatively, "centered position") means a position assumed by the described component when the structural bearing is not subjected to lateral loads.

In a preferred embodiment, the structural bearing is adapted to similarly respond to lateral loading in a second direction (typically but not necessarily perpendicular to the first direction). In this preferred embodiment, the structural bearing further includes a middle bearing plate and a second (or upper) load-bearing lateral displacement means, positioned between the first (or lower) load-bearing lateral displacement means and the upper bearing plate, such that when the supported vertical load is subjected to lateral loading in both the first and second directions:

- the upper bearing plate will be laterally displaced, in the second direction, relative to the upper lateral displacement means;
- the upper lateral displacement means will be laterally displaced, in the second direction relative to the middle bearing plate;
- the middle bearing plate will be laterally displace, in the first direction, relative to the lower lateral displacement means;
- the lower lateral displacement means will be laterally displaced, in the first direction, relative to the lower bearing plate; and
- vertical loads applied to the upper bearing plate will be transferred in turn through the upper lateral displacement means, the middle bearing plate, the lower lateral displacement means, and the lower bearing plate, and then to the supporting structure.

In this embodiment, the structural bearing includes additional centering means, for returning the middle bearing plate and the upper lateral displacement means to their neutral positions upon removal of the lateral loads causing lateral displacement thereof.

In one embodiment, the lower and upper load-bearing lateral displacement means are provided in the form of roller beds each comprising roller means in the form of a plurality of elongate rollers mounted in a retaining frame or cage, with the elongate rollers in each roller bed having parallel and coplanar rotational axes.

However, the present invention is not limited to lateral displacement means using elongate rollers. By way of non-limiting example, lateral displacement means in alternative embodiments could comprise different roller means, which (by way of non-limiting example) could be provided in the form of multiple sets of wheel-like rollers mounted on parallel axles, or in the form of a ball bearing bed comprising ball bearings disposed within a suitable retaining frame or cage.

Other alternative embodiments may use the lateral displacement means may comprise a lubricated steel slide plate, with the slide plate being slidable relative to the bearing plates above and below it. Lubrication of the slide plate could be provided by a suitable grease or oil, or alternatively by applying a low-friction material or coating to the surfaces of the slide plate (and/or the surfaces of the associated bearing plates). Lateral displacement means in accordance with such alternative embodiments may be best suited (but not necessarily restricted) to applications requiring support of comparatively light vertical loads, with lateral displacement means using heavy-duty rollers or ball bearings being a preferred choice for (but not restricted to) applications requiring support of heavier vertical loads.

In one embodiment, each centering means comprises helical springs arranged so as to be compressed in response to lateral loading and corresponding lateral displacement of the associated lateral displacement means or bearing plate, such that upon removal of the lateral load, the compressed springs will automatically restore the associated lateral displacement means or bearing plate to its initial position as the springs rebound to their unstressed states. However, the present invention is not limited to centering means using helical compression springs. By way of non-limiting example, centering means in alternative embodiments could comprise springs that are put into tension rather than compression in response to lateral displacement of associated lateral displacement means or bearing plates. Other embodiments could use springs of a type different from helical springs.

Moreover, centering means for use with structural bearings in accordance with the present invention do not necessarily have to use springs of any type. By way of non-limiting example, further alternative embodiments may be devised using hydraulic cylinders, screw jacks, or other known devices that can be shortened or elongated in response to a force exerted by lateral displacement of an associated bearing plate or lateral displacement means, and which will naturally rebound or will be otherwise restored to a neutral or unloaded state upon removal or relaxation of the applied lateral force, thereby moving the displaced bearing plate or lateral displacement means back to a neutral or centered position (by means of suitable mechanical linkages). Centering means in accordance with still further embodiments may be adapted to mobilize gravity forces to re-center the bearing plates and lateral displacement means upon removal of lateral loads.

BRIEF DESCRIPTION OF THE DRAWINGS

Embodiments of the invention will now be described with reference to the accompanying figures, in which numerical references denote like parts, and in which.

DETAILED DESCRIPTION

Figure 1:
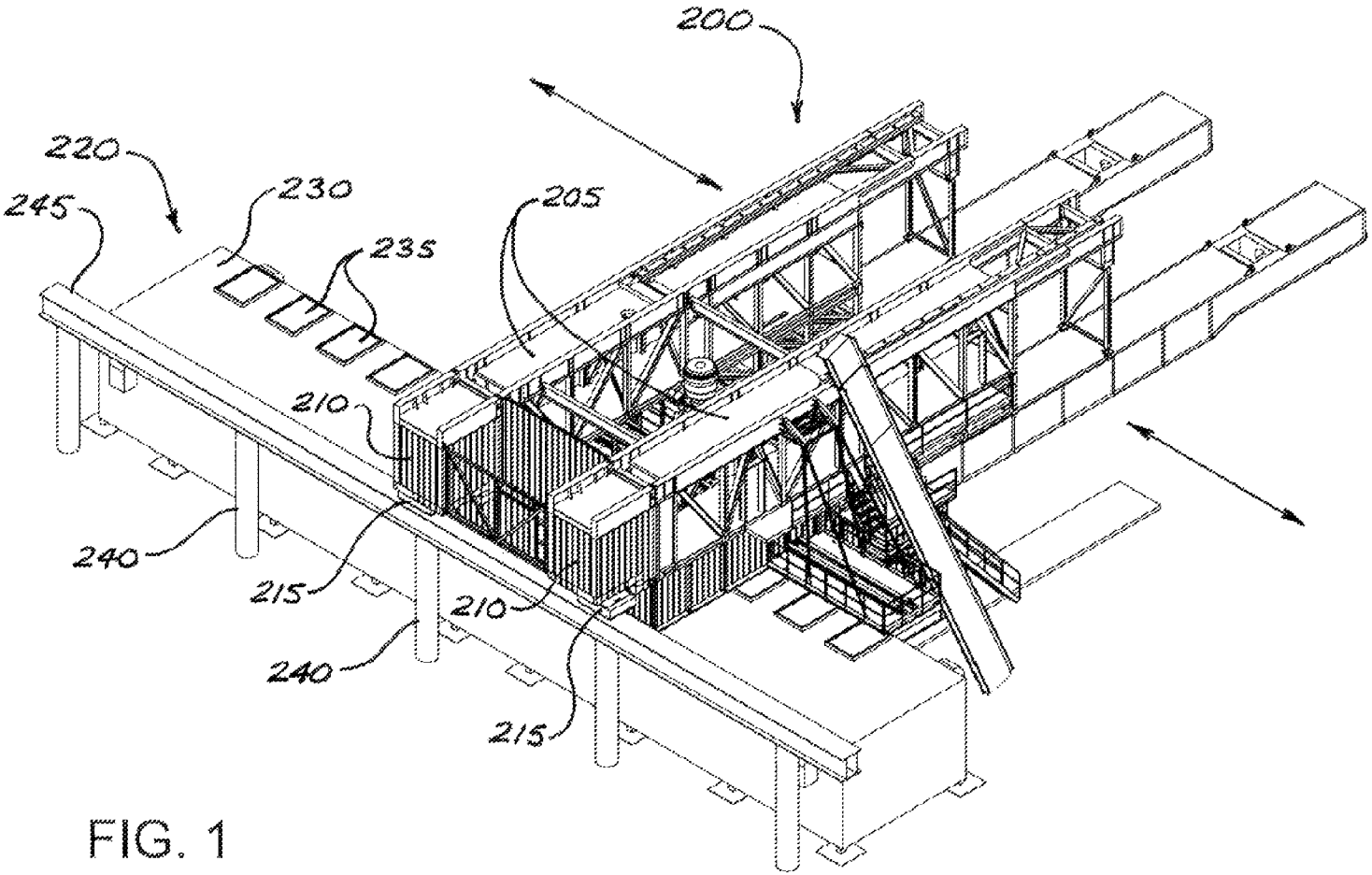
FIG. 1 (Prior Art)
FIG. 1 is a conceptual view of a prior art mobile drilling rig having a cantilevered drill floor, shown positioned over a wellhead enclosure.

FIG. 1 illustrates a prior art mobile drilling rig 200 having tracks 205 for a sliding drill floor (not shown), plus two cantilevered superstructure sections 210 each having a telescoping support leg 215. Mobile rig 200 is shown positioned with cantilevered sections 210 extending over a wellhead enclosure 220 such that support legs 215 are in position for downward extension to bear upon a girder 245 supported by columns 240 and running along one side of enclosure 220. Enclosure 220 has a roof 230 with a plurality of access hatches 235 positioned along the length of enclosure 220 according to the spacing of wellheads (not shown) enclosed within enclosure 220. To drill a well at a designated wellhead location, mobile rig 200 is moved as required in a direction parallel to girder 245 (as indicated by the dual-headed arrows in FIG. 1) so as to be aligned in a first (or longitudinal) direction with the selected well. The corresponding access hatch 235 in roof 230 is then opened, and sliding rig floor (not shown) is moved in a lateral direction along tracks 205 until the rig mast (not shown) is centered over the wellhead location.

FIGS. 2 through 4C illustrate a first embodiment of a structural bearing 10 in accordance with the teachings of the present invention. FIGS. 5A-5H illustrate the detailed assembly of the structural bearing 10 in FIGS. 2 through 4C.

In the illustrated embodiment, structural bearing 10 comprises a lower bearing plate 20 having an upper surface 21 and a lower surface 25, with lower surface 25 being intended for resting on a structural support (such as girder 245 shown in FIG. 1). The size and thickness of lower bearing plate 20 will be selected to suit material properties and design criteria applicable to specific intended uses. By way of non-limiting example, in one embodiment intended for use to support large vertical loads from a telescoping support leg under a cantilevered section of a mobile drill rig, lower bearing plate 20 is 48 inches by 60 inches in plan dimensions, and 2.50 inches in thickness.

Figure 3:
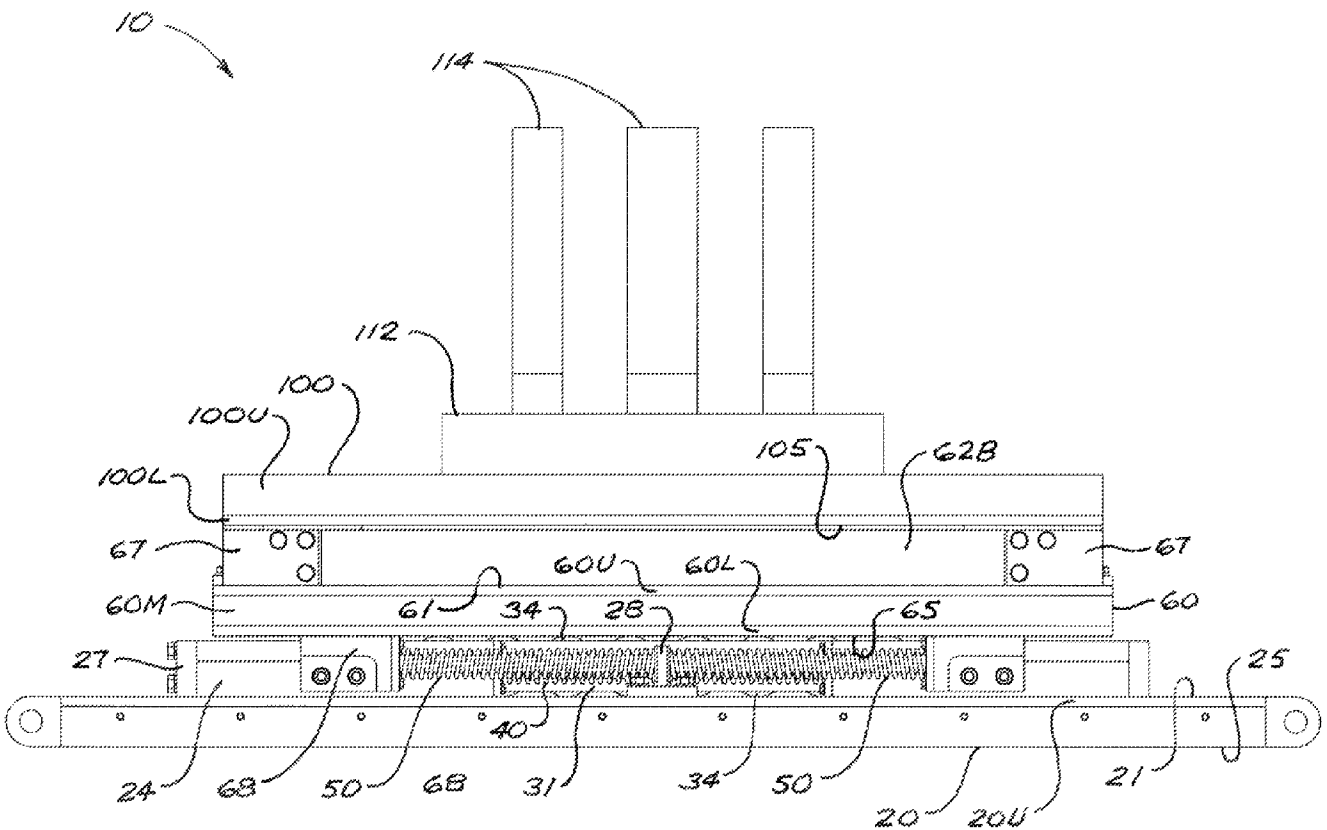
FIG. 3 is a first side view of the structural bearing in FIG. 2, in a neutral or centered configuration.
Figure 4:
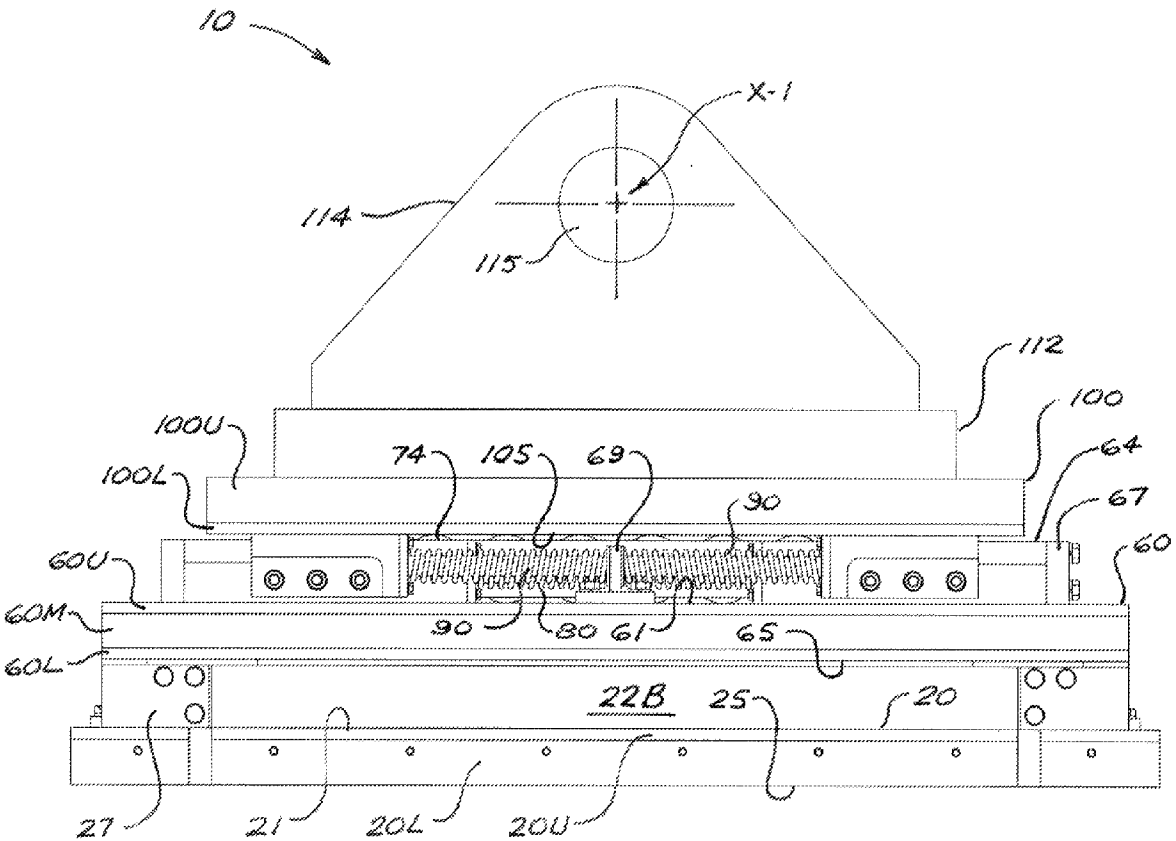
FIG. 4 is a second side view of the structural bearing in FIG. 2, in a neutral or centered configuration.

Preferably but not necessarily, lower bearing plate 20 comprises an upper plate 20U overlying a lower plate 20L, as shown in FIGS. 3 and 4. In this preferred embodiment, upper plate 20U is preferably made from a wear-resistant material such as (but not restricted to) QT100, which is a quenched and tempered, high-strength weldable steel. Upper plate 20U thus defines upper surface 21 of lower bearing plate 20. This construction allows lower plate 20L to be fabricated from a structurally sufficient mild steel rather than the alternative of making upper plate 20 entirely from a more expensive material such as QT100 to provide optimal wear resistance when structural bearing 10 is in service under heavy vertical and horizontal loads. Upper plate 20U and lower plate 20L may be joined to form an integral lower bearing plate 20 by any suitable means. By way of non-limiting example, and as illustrated in FIG. 5A, one way of doing this is to provide upper plate 20U with a number of preferably elongate slots 23, so that upper plate 20U can be welded to lower plate 20L.

Figure 5A:
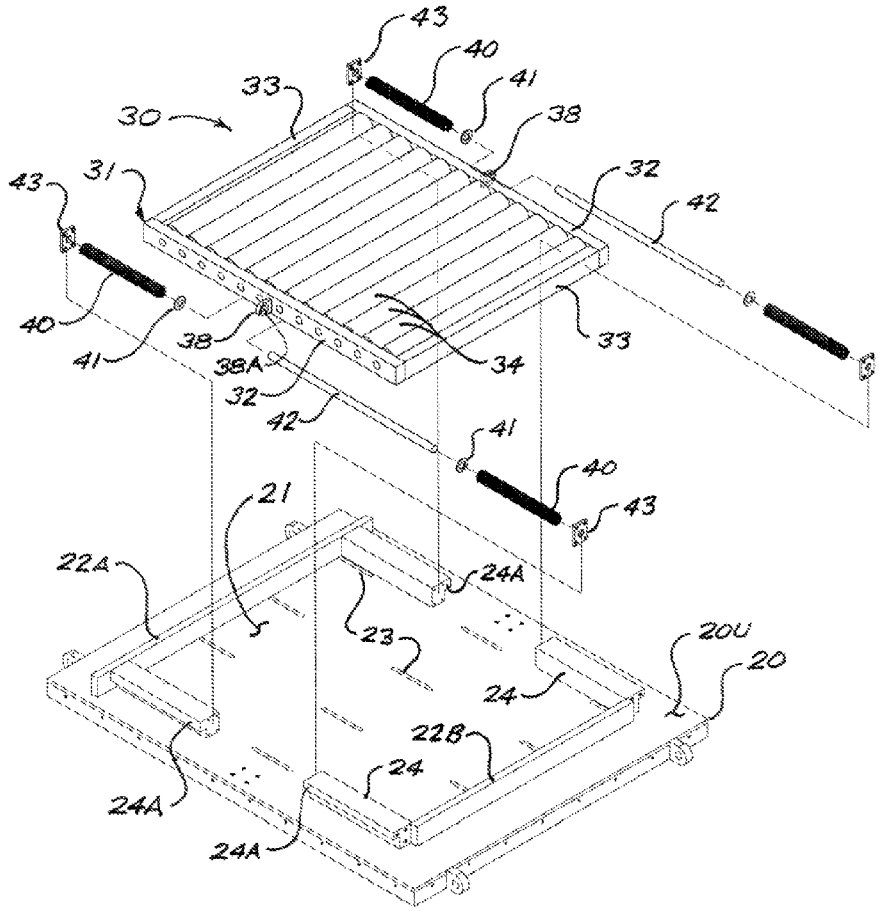
FIG. 5A is an exploded isometric view of the auto-centering structural bearing in FIG. 2, illustrating the assembly of the lower roller bed, the lower bearing plate, and the first (or inner lower) centering means.

Also as best seen in FIG. 5A, a pair of spaced and parallel lower fence members 22 are mounted to and project upward from upper surface 21 of lower bearing plate 20. In the illustrated embodiment, and for reasons explained later herein, one lower fence member is longer than the other; for clarity, reference numbers 22A and 22B will be used to denote the longer and shorter fence members, respectively. A lower roller bed 30, comprising a plurality of heavy-duty cylindrical rollers 34 rotatably mounted in parallel within a lower roller frame 31, is positioned upon upper surface 21 of lower bearing plate 20 so as to be rollingly movable thereupon, in either direction transverse to lower fence members 22 (which in turn define and limit the range of movement of lower roller bed 30 relative to lower bearing plate 20). The length and diameter of rollers 34 will be selected to suit case-specific design criteria. By way of non-limiting example, in one embodiment intended for use to support large vertical loads, rollers 34 are 3.00 inches in diameter and about 36 inches in length.

In the illustrated embodiment, lower roller frame 31 comprises parallel side members 32 extending between parallel end members 33, with side members 32 being adapted (e.g., with suitable bearing means) to support rollers 34 in rotatable fashion. Persons skilled in the art will appreciate that end members 33 are not essential to the invention, and also that lower roller frame 31 in alternative embodiments may have side members 32 that are not parallel.

Figure 5B:
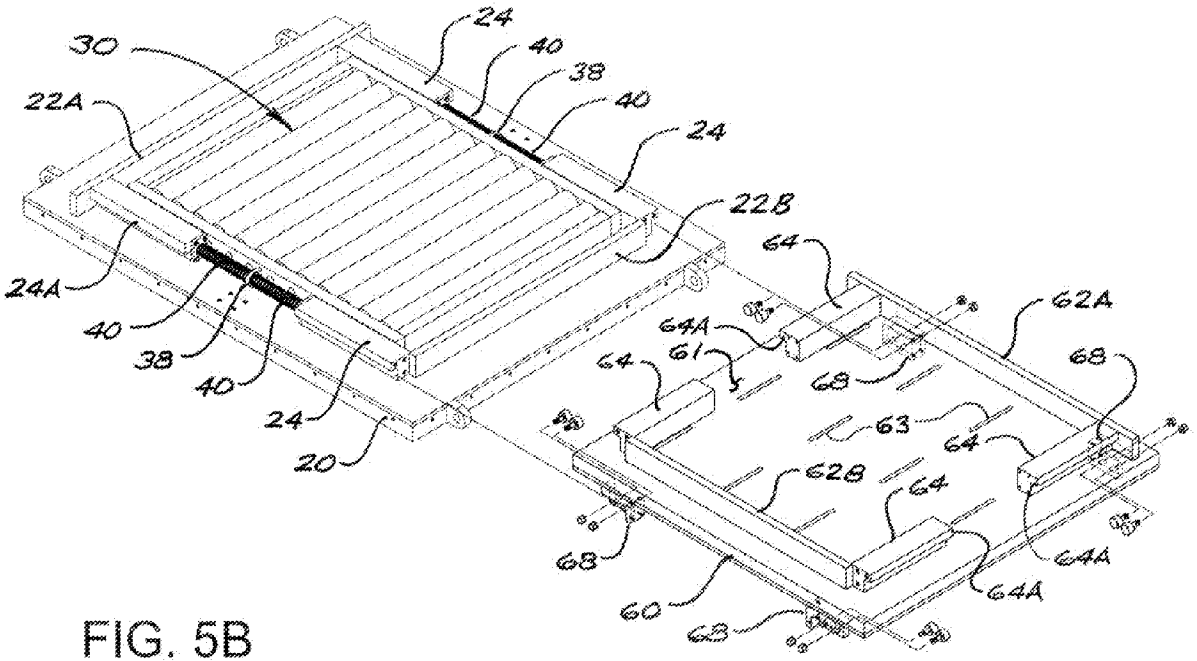
FIG. 5B is an exploded isometric view illustrating the assembly of the middle bearing plate with the subassembly in FIG. 5A.

Lower bearing plate 20 is also provided with a first centering means for biasing lower roller bed 30 toward a neutral or centered position relative to lower bearing plate 20. Persons skilled in the art will readily appreciate that the first centering means can be provided in a variety of forms using known concepts and technologies, and the present invention is not limited by or restricted to the use of any particular type of centering means. However, as shown in FIGS. 5A and 5B, the first centering means in the illustrated embodiment, comprises two pairs of helical compression springs 40, with each pair of springs 40 being disposed around an elongate spring rod 42 extending between and mounted (using suitable mounting hardware such as rod mounting brackets 43) to a pair of spaced abutments 24 which in turn are mounted on upper surface 21 of lower bearing plate 20, adjacent to and clear of the travel path of lower roller bed 30, such that spring rod 42 is parallel to the direction of travel of lower roller bed 30. In this embodiment, abutments 24 effectively serve as lateral guide means for lower roller bed 30 as it moves between fence members 22A and 22B, preventing or limiting lateral displacement of lower roller bed 30 relative to lower bearing plate 20 in a direction parallel to the axes of rollers 34.

Each spring rod 42 passes through an opening 38A in a lug member 38 projecting laterally outward from a medial region of a corresponding side member 32 of lower roller frame 31, such that for each pair of helical springs 40, one spring 40 is disposed around the corresponding spring rod 42 on each side of the corresponding lug member 38 on lower roller frame 31. As illustrated, each spring rod 42 will preferably carry a washer 41 on either side of and adjacent to the corresponding lug member 38 to facilitate uniform application of compressive force into springs 40.

Accordingly, when lower roller bed 30 is moved in either direction between lower fence members 22, one helical spring 40 on each side of lower roller bed 30 will be compressed between a corresponding lug member 38 and a corresponding abutment 24. Removal of the external force causing the movement of lower roller bed 30 will in turn relieve the compressive load in the compressed springs 40, which as a result will urge lug members 38, and lower roller bed 30 with them, back toward the neutral or centered position relative to lower bearing plate 20.

As will be described later in this specification, the illustrated embodiment of structural bearing 10 comprises second, third, and fourth centering means using helical compression springs similar to the first centering means described above. For enhanced clarity and to distinguish between the various centering means and related components, the first centering means may be alternatively referred to as the inner lower centering means, and helical springs 40 may be alternatively referred to as inner lower springs 40. Similar alternative terminology will also be used for the other centering means described later herein.

Referring to FIGS. 3, 4, and 5B, structural bearing 10 also comprises a middle bearing plate 60 having an upper surface 61 and a lower surface 65. In the illustrated embodiment, middle bearing plate 60 comprises a middle plate 60M (which may be made from mild steel), and upper and lower plates 60U and 60L, which like upper plate 20U of lower bearing plate 20 are preferably made from a wear-resistant material such as QT100. Accordingly, in this embodiment, upper and lower plates 60U and 60L thus define upper and lower surfaces 61 and 65, respectively, of middle bearing plate 60. Also similar to upper plate 20U of lower bearing plate 20, upper and lower plates 60U and 60L of middle bearing plate 60 may be secured to middle plate 60M by welding, facilitated by slots 63 formed in upper and lower plates 60U and 60L.

Figure 3A:
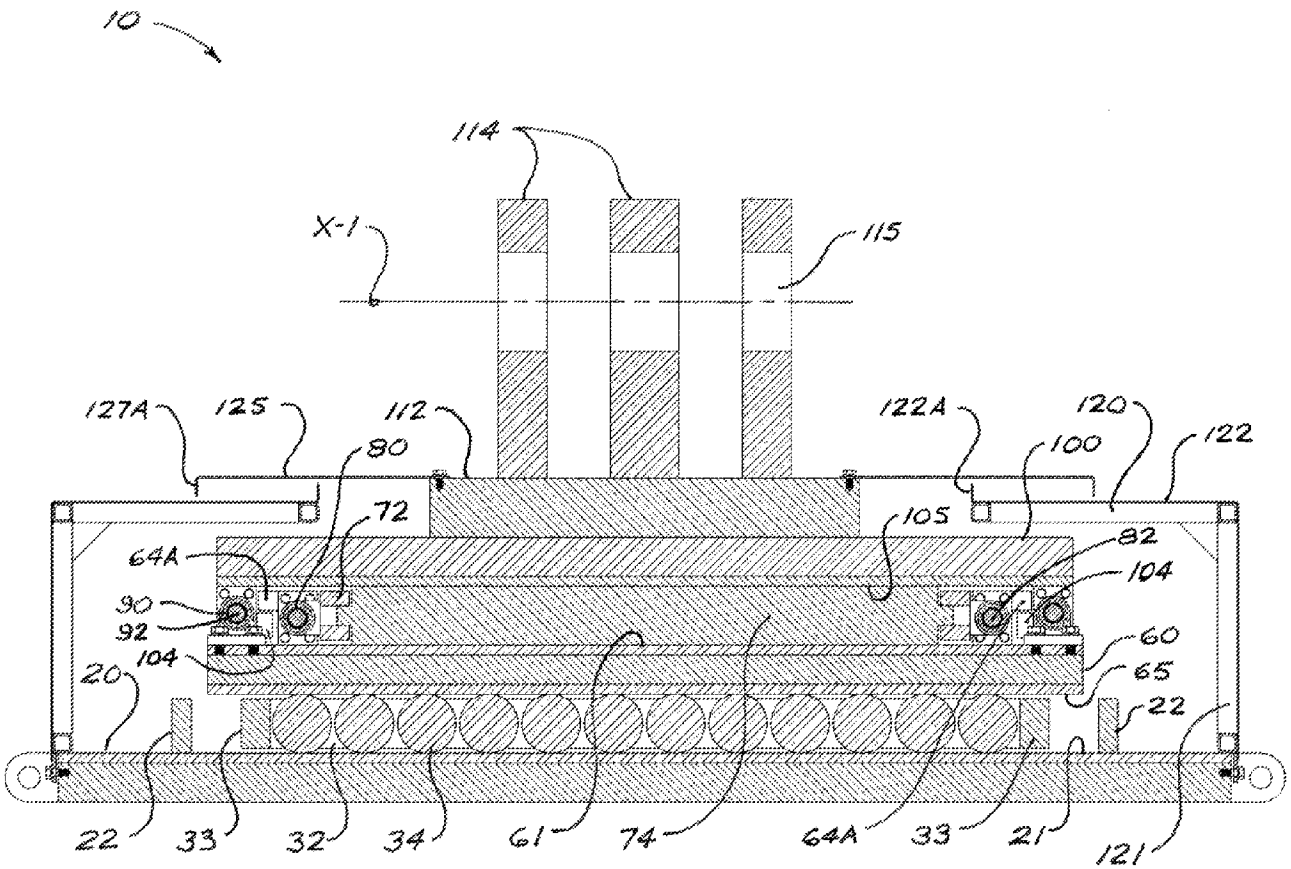
FIG. 3A is a first cross-section through the structural bearing in FIG. 2, in a centered configuration with protective covers installed.
Figure 3B:
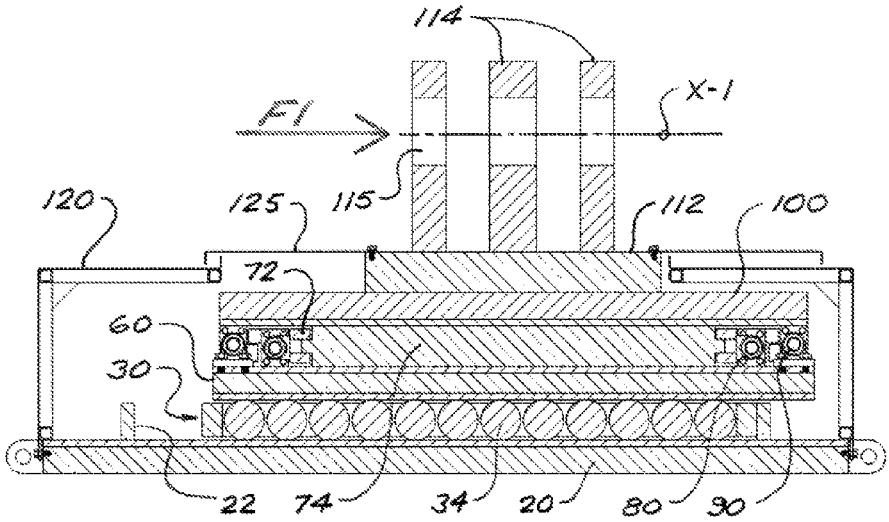
FIG. 3B is a cross-section similar to FIG. 3A, but with the structural bearing in a laterally offset configuration.
Figure 3C:
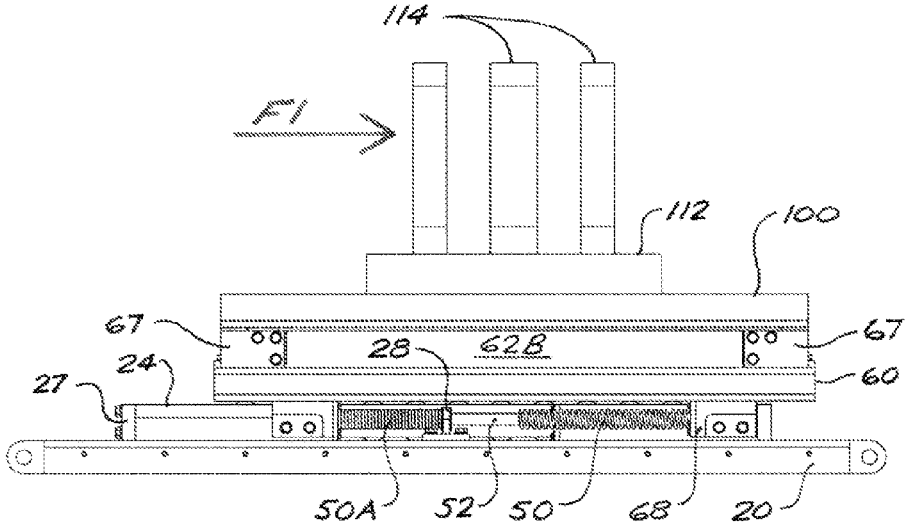
FIG. 3C is a side view similar to FIG. 3, but with the structural bearing laterally offset as in FIG. 3B.
Figure 5C:
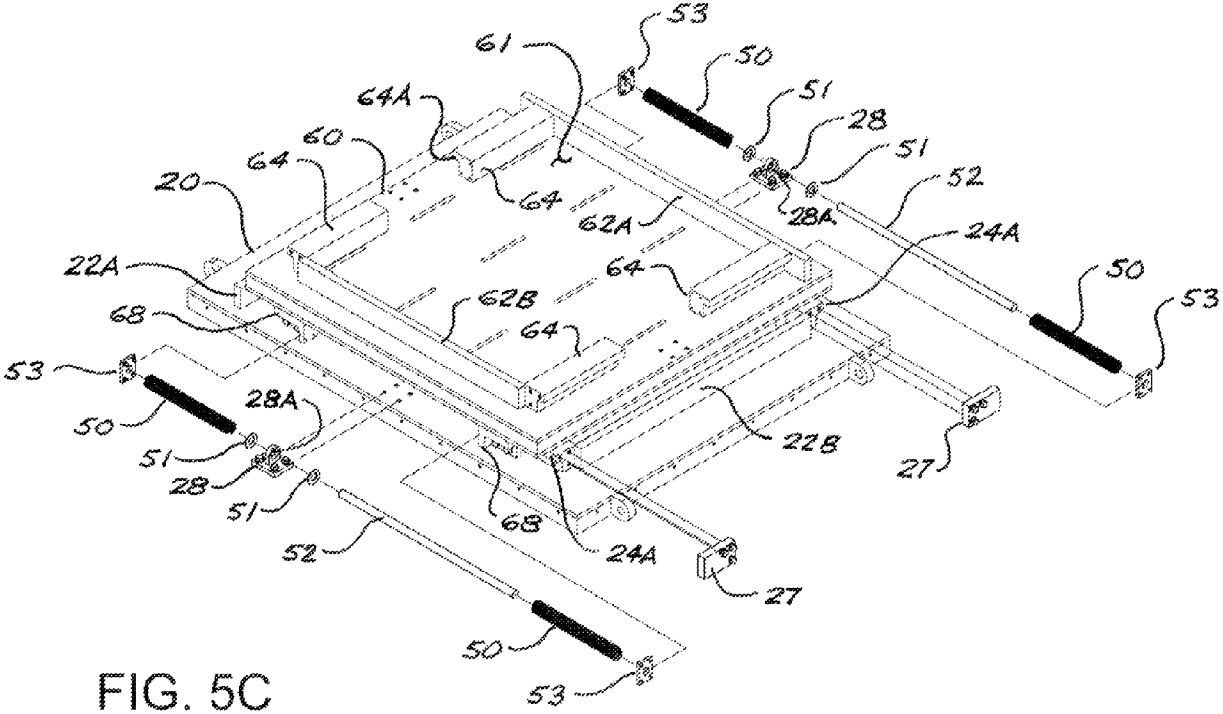
FIG. 5C is an exploded isometric view illustrating the assembly of the middle bearing plate with the subassembly in FIG. 5B, in conjunction with the second (or outer lower) centering means.

As illustrated in FIGS. 5B and 5C, with lower roller bed 30 positioned on upper surface 21 of lower bearing plate 20, middle bearing plate 60 is positioned over lower roller bed 30 such that lower surface 65 of middle bearing plate 60 contacts rollers 34 of lower roller bed 30. Accordingly, when a lateral force F1 is applied to structural bearing 10 in a direction transverse to the axes of rollers 34, as shown in FIGS. 3B and 3C, and while the overall assembly is under vertical compressive load as well, lower roller bed 30 will roll over lower bearing plate 20 in the same direction. As a result, middle bearing plate 60 will roll over rollers 34 a corresponding amount in the same direction.

Figure 5D:
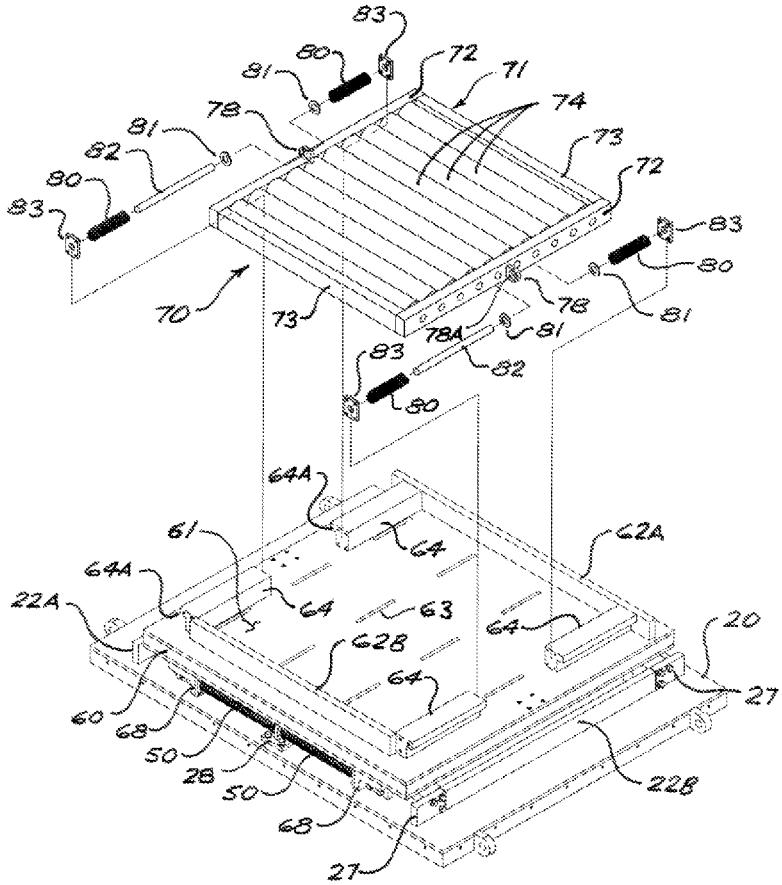
FIG. 5D is an exploded isometric view illustrating the assembly of the upper roller bed and the middle bearing plate, in conjunction with the third (or inner upper) centering means.

To facilitate centering of middle bearing plate 60 relative to lower bearing plate 20, structural bearing 10 preferably incorporates a second (or outer lower) centering means generally similar to the first (or inner lower) centering means described previously, and as best understood with reference to FIGS. 5C and 5D. In the illustrated embodiment, the second (or outer lower) centering means comprises two pairs of helical compression springs 50 (or outer lower springs 50), with each pair of outer lower springs 50 being disposed around an elongate spring rod 52 extending between and mounted (using rod mounting brackets 53) to a pair of spaced abutments 68 which in turn are mounted to and project downward from lower surface 65 of middle bearing plate 60, externally adjacent and parallel to a corresponding pair of inner lower springs 40 of the first centering means. Each outer lower spring rod 52 passes through an opening 28A in a lug member 28 mounted to and projecting upward from a medial side region of lower bearing plate 20, such that for each pair of outer lower springs 50, one spring 50 is disposed around the corresponding outer lower spring rod 52. Accordingly, when middle bearing plate 60 is laterally displaced in either direction relative to lower roller bed 30 and lower bearing plate 20 as previously described, one outer lower spring 50 on each side of lower roller bed 30 will be compressed between a corresponding lug member 28 and a corresponding abutment 68. This can be seen in FIG. 3C, in which the compressed outer lower spring is indicated by reference number 50A. Preferably, each outer lower spring rod 52 carries a washer 51 on either side of the corresponding lug member 28 to facilitate uniform application of compressive force into outer lower springs 50.

Removal of external force F1 will relieve the compressive load in compressed outer lower springs 50A, which as a result will urge middle bearing plate 60 back toward a neutral or centered position relative to lower bearing plate 20.

Middle bearing plate 60 may be adapted to accommodate lateral displacement relative to lower bearing plate 20 without vertical separation when structural bearing 10 is in a suspended condition (such as, for example, when incorporated into a vertically extendable support leg 215 as in the mobile cantilever drill rig 200 shown in FIG. 1). It will be readily apparent to persons skilled in the art that this preferred feature can be provided in a variety of ways by non-inventive adaptation of known concepts and technologies.

Figure 4A:
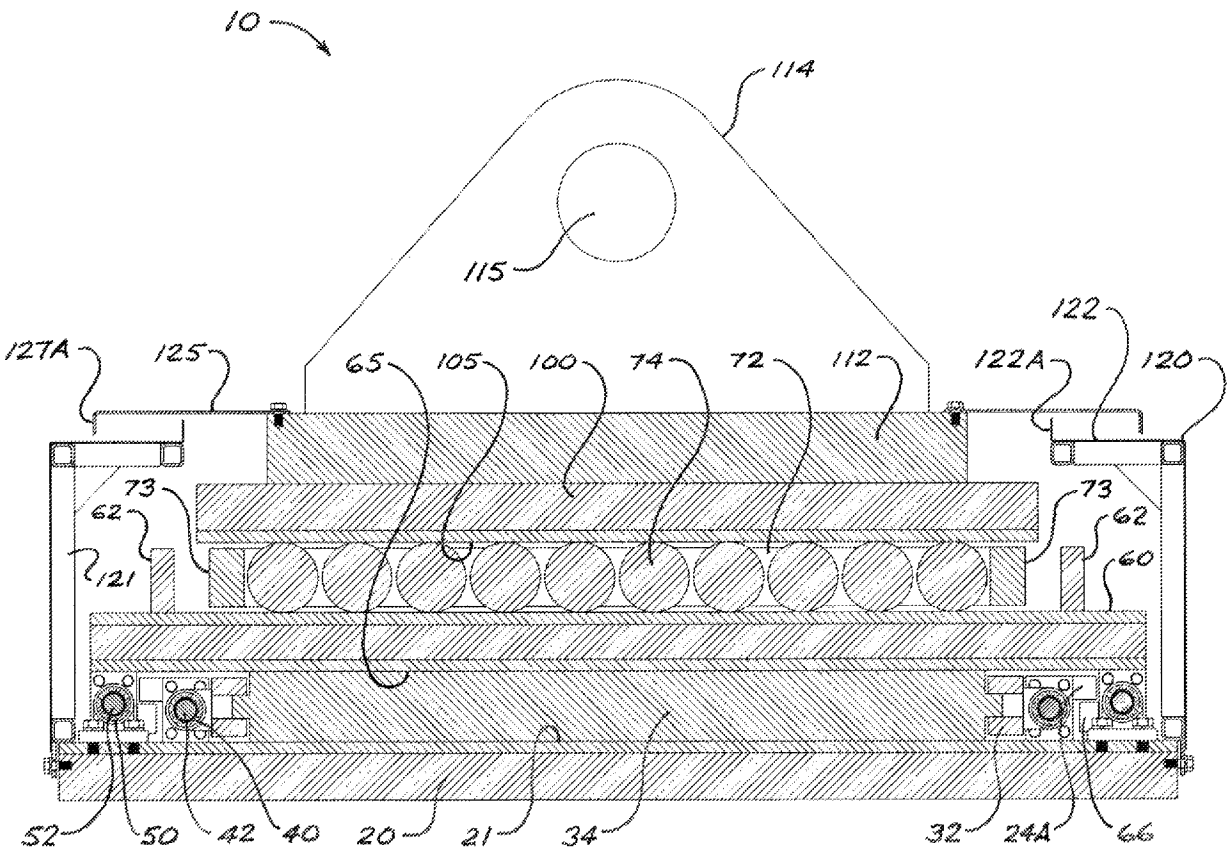
FIG. 4A is a second cross-section through the structural bearing in FIG. 2, in a centered configuration with protective covers installed.

In the illustrated embodiment, however, this is accomplished by forming abutments 24 on lower bearing plate 20 with outwardly-extending elongate flanges 24A as shown in FIGS. 5A and 5B, and providing each abutment 68 mounted to the underside of middle bearing plate 60 with one or more inwardly-projecting lugs 66 configured and located to slide under flanges 24A of abutments 24, as best seen in FIG. 4A. When structural bearing 10 is in a suspended condition, lower bearing plate 20 will be effectively suspended from middle bearing plate 60 due to flanges 24A (which are connected to lower bearing plate 20) supported on lugs 66 (which are connected to middle bearing plate 60).

In alternative embodiments, intended for use in service conditions in which structural bearing 10 will at all times rest on a supporting structure and therefore will not be suspended, there will be no necessity for means for preventing vertical separation between lower and middle bearing plates 20 and 60. In such service conditions, rollers 34 will at all times maintain compressive contact with upper surface 21 of lower bearing plate 20 and with lower surface 65 of middle bearing plate 60. In such alternative embodiments, the second (or outer lower) centering means may be unnecessary, depending on the magnitude of the vertical load applied to structural bearing 10. Provided that it has sufficient strength, the first (or inner lower) centering means by itself may be effective to center middle bearing plate 60 as well as lower roller bed 30 upon removal of loads or conditions causing lateral displacement thereof in the first direction. As mentioned previously, when lower roller bed 30 is laterally displaced relative to lower bearing plate 20 in the first direction, middle bearing plate 60 will be resultantly displaced a corresponding amount in the same direction relative to lower roller bed 30, due to the fact that rollers 34 roll equally relative to both upper surface 21 of lower bearing plate 20 and lower surface 65 of middle bearing plate 60. Therefore, if middle bearing plate 60 is in compressive contact with rollers 34, the action of the first centering means to urge lower roller bed 30 back toward its neutral or centered position will have a corresponding effect on middle bearing plate 60, barring slippage between rollers 34 and lower surface 65 of middle bearing plate 60.

As shown in FIGS. 5A-5C, the longer fence member 22A extends across the ends of abutments 24 while shorter fence member 22B extends between abutments 24 so as to leave clearance to allow middle bearing plate 60 to slide into position over lower roller bed 30, with lugs 66 of abutments 68 sliding under flanges 24A of abutments 24. Suitable end plates 27 are then mounted to the ends of abutments 24 adjacent to the ends of shorter fence member 22B, thus providing a second limit for lateral displacement of middle bearing plate 60 relative to lower bearing plate 20.

As illustrated in FIGS. 5C and 5D, middle bearing plate 60 includes a pair of spaced and parallel upper fence members 62 (more specifically, longer fence member 62A and shorter fence member 62B) projecting upward from upper surface 61 of middle bearing plate 60. An upper roller bed 70, comprising a plurality of parallel cylindrical rollers 74 rotatably mounted within an upper roller frame 71, is positioned upon upper surface 61 of middle bearing plate 60 so as to be rollingly movable thereupon, in either direction transverse to upper fence members 62 (which in turn define and limit the range of movement of upper roller bed 70 relative to middle bearing plate 60). In the illustrated embodiment, upper roller frame 71 comprises parallel side members 72 extending between parallel end members 73, with side members 72 being adapted to rotatably support rollers 74.

Figure 5E:
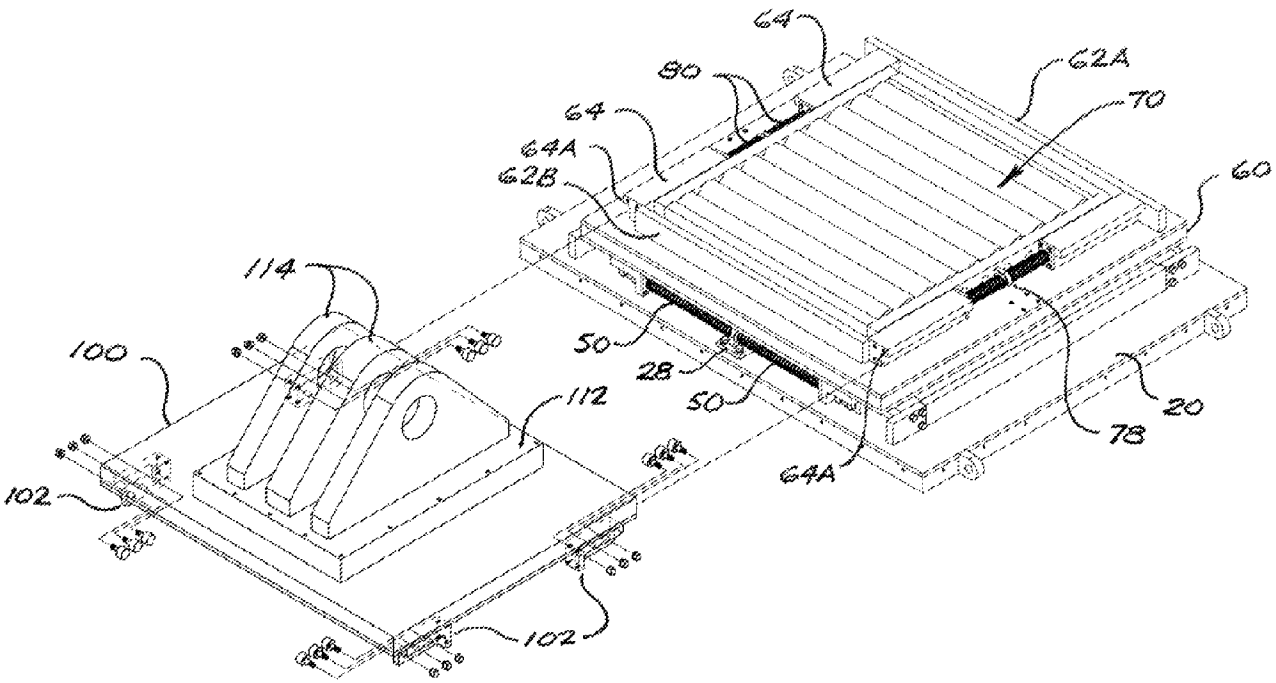
FIG. 5E is an exploded isometric view illustrating the assembly of the upper bearing plate with the subassembly in FIG. 5D.

As shown in FIGS. 5D and 5E, middle bearing plate 60 is also provided with a third (or inner upper) centering means for biasing upper roller bed 70 toward a neutral or centered position relative to middle bearing plate 60. In the illustrated embodiment, the third centering means comprises two pairs of helical compression springs 80 (or inner upper springs 80), with each pair of springs 80 being disposed around an elongate inner upper spring rod 82 extending between and mounted (using rod mounting brackets 83) to a pair of spaced abutments 64 which in turn are mounted on upper surface 61 of middle bearing plate 60, adjacent to and clear of the travel path of upper roller bed 70, such that inner upper spring rod 82 is parallel to the direction of travel of upper roller bed 70. In this embodiment, abutments 64 effectively serve as lateral guide means for upper roller bed 70 as it moves between fence members 62A and 62B, preventing or limiting lateral displacement of upper roller bed 70 relative to middle bearing plate 60 in a direction parallel to the axes of rollers 74.

Each inner upper spring rod 82 passes through an opening 78A in a lug member 78 projecting laterally outward from a medial region of a corresponding side member 72 of upper roller frame 71, such that for each pair of helical springs 80, one spring 80 is disposed around the corresponding spring rod 82 on each side of the corresponding lug member 78 on upper roller frame 71 (preferably with washers 81 on each side of lug member 78).

Accordingly, when upper roller bed 70 is moved in either direction between upper fence members 62, one helical spring 80 on each side of upper roller bed 70 will be compressed between a corresponding lug member 78 and a corresponding abutment 64. Removal of the external force causing the movement of upper roller bed 70 will in turn relieve the compressive load in the compressed springs 80, which as a result will urge lug members 78, and upper roller bed 70 with them, back toward the neutral or centered position relative to middle bearing plate 60.

It will be immediately apparent that upper roller bed 70, the third centering means, fence members 62, and abutments 64 in the illustrated embodiment are similar in configuration and construction to lower roller bed 30, the first centering means, fence members 32, and abutments 34, respectively. However, the direction of travel of upper roller bed 70 is transverse to the direction of travel of lower roller bed 30. Accordingly, the illustrated embodiment of structural bearing 10 accommodates lateral loading in two directions, and is auto-centering in both directions upon removal of the lateral loads.

Referring to FIGS. 3, 4, and 5E, structural bearing 10 also comprises an upper bearing plate 100 having a lower surface 105. In the illustrated embodiment, upper bearing plate 100 comprises an upper plate 100U (which may be made from mild steel), and a lower plate 100L, preferably made from a wear-resistant material. Accordingly, in this embodiment, lower plate 100L thus defines lower surface 105 of upper bearing plate 100.

Figure 4B:
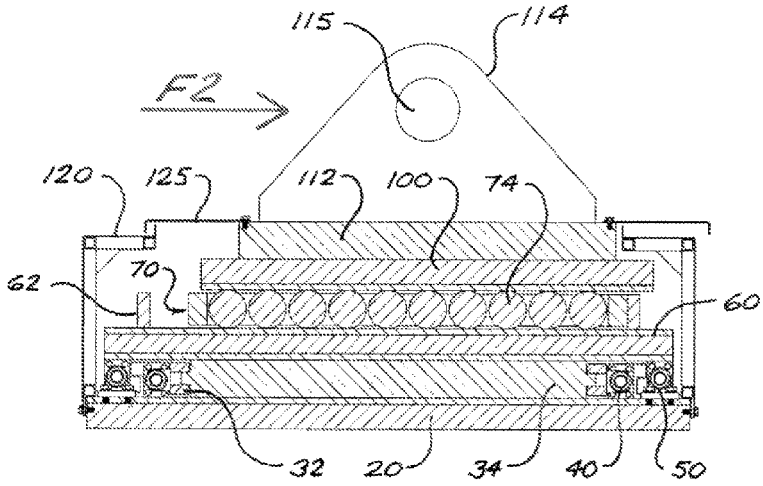
FIG. 4B is a cross-section similar to FIG. 4A, but with the structural bearing in a laterally offset configuration.
Figure 4C:
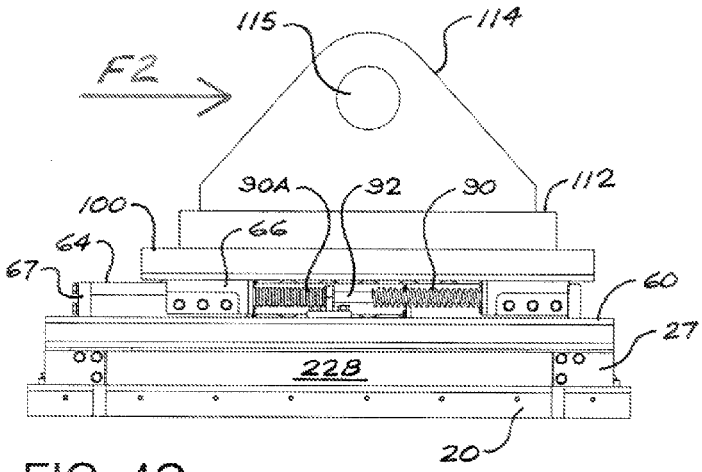
FIG. 4C is a side view similar to FIG. 4, but with the structural bearing laterally offset as in FIG. 4B.
Figure 5F:
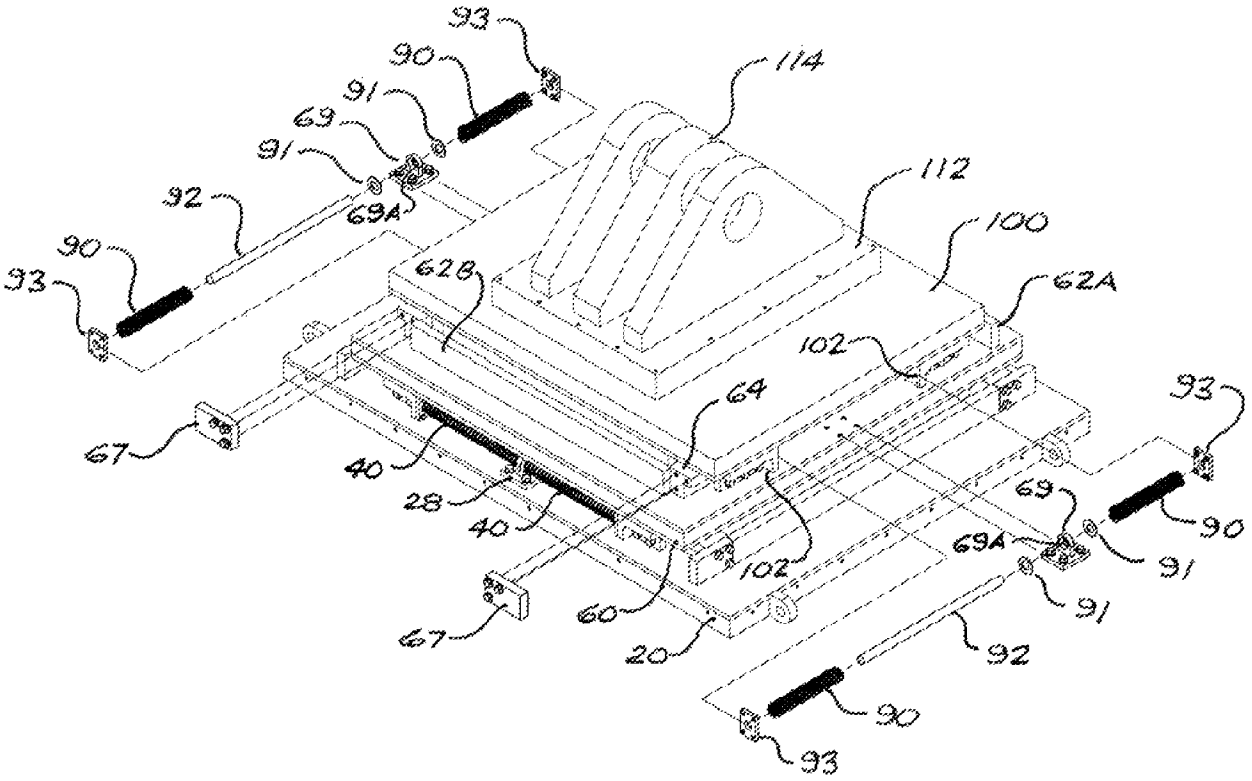
FIG. 5F is an exploded isometric view illustrating the assembly of the fourth (or outer upper) centering means with the subassembly in FIG. 5E.

As illustrated in FIGS. 5E and 5F, with upper roller bed 70 positioned on upper surface 61 of middle bearing plate 60, upper bearing plate 100 is positioned over upper roller bed 70 such that lower surface 105 of upper bearing plate 100 contacts rollers 74 of upper roller bed 70. Accordingly, when a lateral force F2 is applied to structural bearing 10 in a direction transverse to the axes of rollers 74, as shown in FIGS. 4B and 4C, and while the overall assembly is under vertical compressive load as well, upper roller bed 70 will roll over upper bearing plate 100 in the same direction. As a result, upper bearing plate 100 will roll over rollers 74 a corresponding amount in the same direction.

To facilitate centering of upper bearing plate 100 relative to middle bearing plate 60, structural bearing 10 preferably incorporates a fourth (or outer upper) centering means, which as shown in FIG. 5F may comprise two pairs of helical compression springs 90 (or outer upper springs 90), with each pair of outer upper springs 90 being disposed around an outer upper spring rod 92 extending between and mounted (using rod mounting brackets 93) to a pair of spaced abutments 102 which in turn are mounted to and project downward from lower surface 105 of upper bearing plate 100, externally adjacent and parallel to a corresponding pair of inner upper springs 80 of the third centering means. Each outer upper spring rod 92 passes through an opening 69A in a lug member 69 mounted to and projecting upward from a medial side region of middle bearing plate 60, such that for each pair of outer upper springs 90, one spring 90 is disposed around the corresponding outer upper spring rod 92. Accordingly, when upper bearing plate 100 is laterally displaced in either direction relative to upper roller bed 70 and middle bearing plate 60 as previously described, one outer lower spring 90A on each side of upper roller bed 70 will be compressed between a corresponding lug member 69 and a corresponding abutment 102. This can be seen in FIG. 4C, in which the compressed outer upper spring is indicated by reference number 90A. Preferably, each outer upper spring rod 92 carries a washer 91 on either side of the corresponding lug member 69 to facilitate uniform application of compressive force into outer upper springs 90.

Removal of external force F2 will relieve the compressive load in compressed springs 90A, which as a result will urge upper bearing plate 100 back toward a neutral or centered position relative to middle bearing plate 60.

Upper bearing plate 100 may be adapted to accommodate lateral displacement relative to middle bearing plate 60 without vertical separation when structural bearing 10 is in a suspended condition. In the illustrated embodiment, this is accomplished by forming abutments 64 on middle bearing plate 60 with outwardly-extending elongate flanges 64A as shown in FIGS. 5B through 5E, and providing each abutment 102 mounted to the underside of upper bearing plate 100 with one or more inwardly-projecting lugs 104 configured and located to slide under flanges 64A of abutments 64, as best seen in FIG. 3A. When structural bearing 10 is in a suspended condition, middle bearing plate 60 will be effectively suspended from upper bearing plate 100 due to flanges 64A (which are connected to middle bearing plate 60) supported on lugs 104 (which are connected to upper bearing plate 100).

In alternative embodiments, intended for use in service conditions in which structural bearing 10 will at all times rest on a supporting structure and therefore will not be suspended, there will be no necessity for means for preventing vertical separation between middle and upper bearing plates 60 and 100. In such alternative embodiments, the fourth (or outer upper) centering means may be unnecessary, for reasons essentially as set out previously with respect to alternative embodiments not requiring the second (or outer lower) centering means.

As shown in FIGS. 5A-5C, the longer fence member 62A extends across the ends of abutments 64 while shorter fence member 62B extends between abutments 64 so as to leave clearance to allow upper bearing plate 100 to slide into position over upper roller bed 70, with lugs 104 of abutments 102 sliding under flanges 64A of abutments 64. Suitable end plates 67 are then mounted to the ends of abutments 64 adjacent to the ends of shorter fence member 62B, thus providing a second limit for lateral displacement of upper bearing plate 100 relative to middle bearing plate 60.

Figure 2:
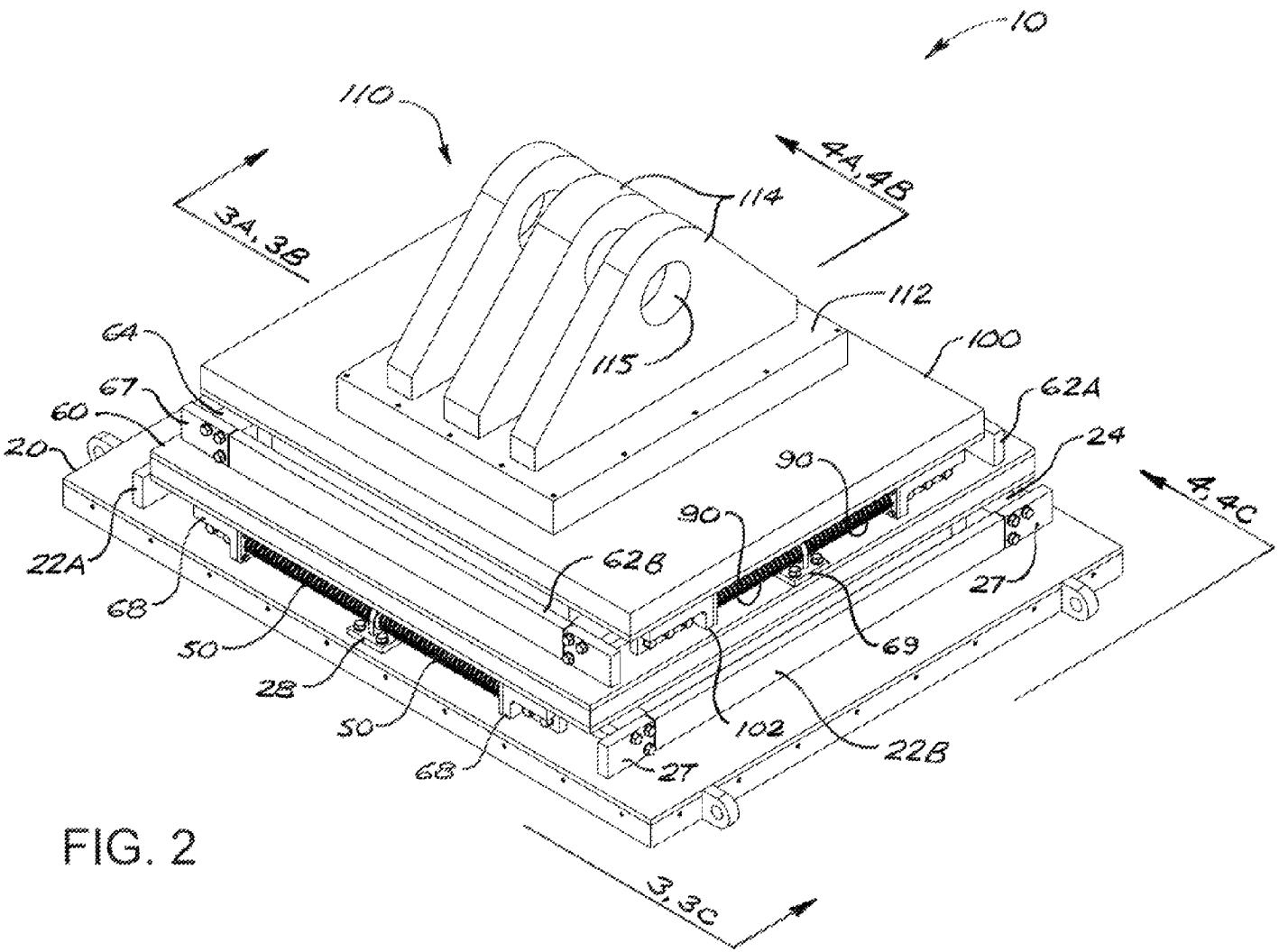
FIG. 2 is an isometric view of an auto-centering structural bearing in accordance with one embodiment of the present invention.

Structural bearing 10 is provided with mounting means (generally indicated by reference number 110) for mounting structural bearing 10 to a supported structural element, such as (by way of non-limiting example) to the lower end of a support leg 215 as in the mobile cantilever drill rig 200 in FIG. 1. In the illustrated embodiment, mounting means 110 is provided in the form of one or more mounting brackets 114 extending upward from upper bearing plate 100 as shown in FIG. 2 and other drawings, with holes 115 to receive a shear pin (not shown) inserted through one or more mating brackets (not shown) on the supported structural element. The shear pin is preferably round in cross-section to allow swiveling between the supported structural element and structural bearing 10 about a swivel axis X-1 as shown in FIG. 3A and other drawings. Persons of ordinary skill will readily understand how structural bearing 10 may be thus mounted to a supported structural element notwithstanding that the above-described mounting arrangement is not illustrated in the drawings. Furthermore, persons skilled in the art will appreciate that alternative forms of mounting means 110 may be readily devised in accordance with known concepts and methods.

Figure 2A:
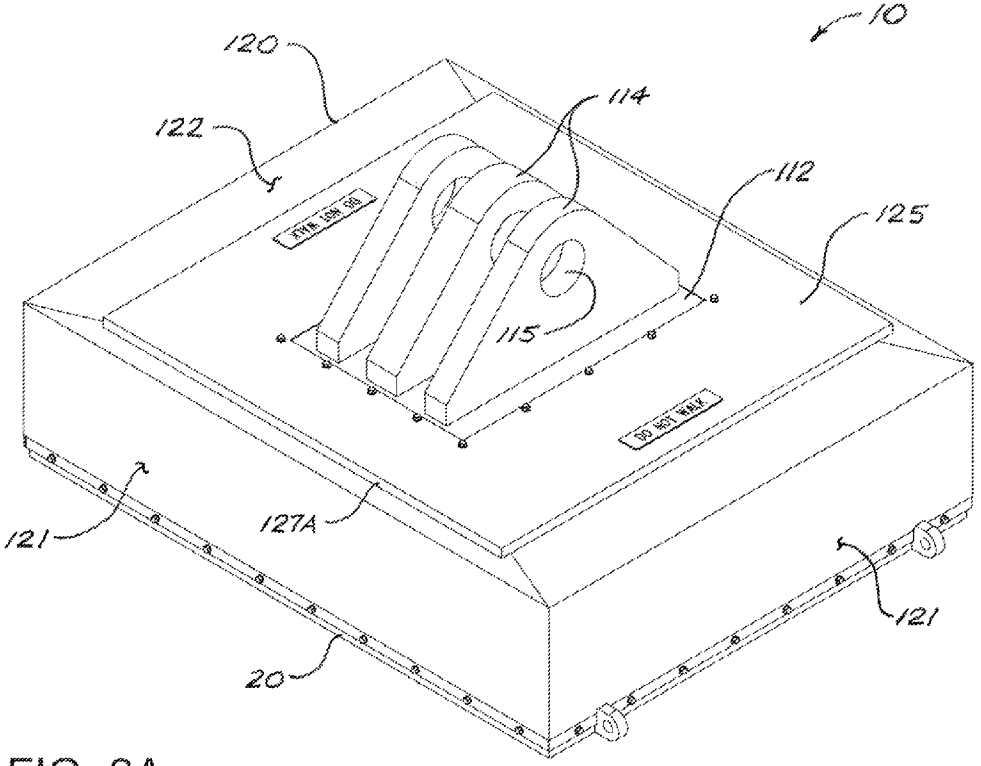
FIG. 2A is an isometric view of the structural bearing in FIG. 2, with protective covers installed.
Figure 5G:
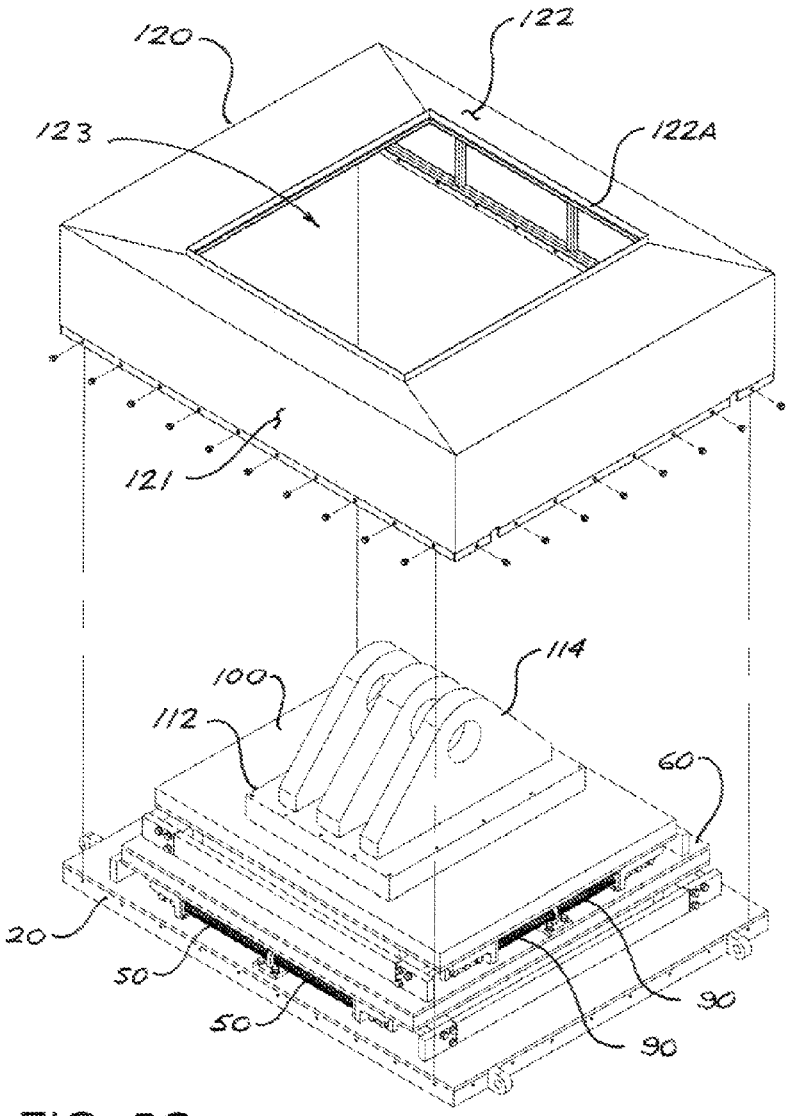
FIGS. 5G and 5H are exploded isometric views illustrating the installation of optional protective covers over the subassembly in FIG. 5F.
Figure 5H:
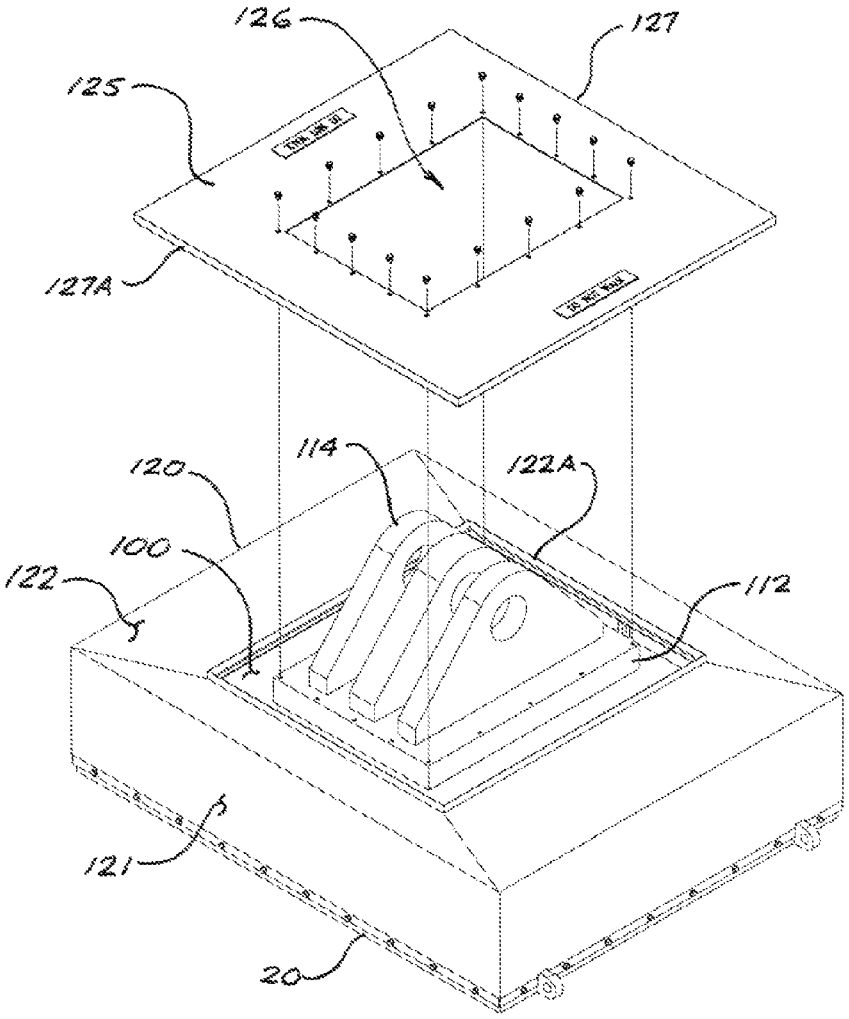

As illustrated in FIGS. 2A, 5G, 5H and other drawings, structural bearing 10 is preferably provided with covers to protect against entry of contaminants such as rain, snow, and dust, while at the same time accommodating lateral displacement in response to lateral loading in any direction. In the illustrated embodiment, a fixed cover 120 is provided in the form of a rectilinear box with side walls 121, a top member 122 with an opening 123, and an open bottom. Fixed cover 120 and opening 123 are sized and configured such that when fixed cover 120 is mounted with side walls 121 supported upon and fastened to lower bearing plate 20, the entire movable subassembly (i.e., lower roller bed 30 plus all components supported thereby) can move through full ranges of lateral displacement in both directions, without physical interference with fixed cover 120.

To accommodate this movement, mounting means 110 projects upward through opening 123 in top member 122 of fixed cover 120. In order to protect against entry of contaminants through opening 123 regardless of the lateral position of the movable subassembly, a travelling cover 125 with an opening 126 is mounted to mounting means 110 in any suitable fashion, such that travelling cover 125 extends over top member 122 of fixed cover 120, and such that the perimeter edge 127 of travelling cover 125 will always overlap top member 122 of fixed cover 120 regardless of the lateral position of the movable subassembly. In the illustrated embodiment, travelling cover 125 is mounted to mounting means 110 by interposing a base plate 112 between upper bearing plate 100 and mounting brackets 114, such that travelling cover 125 can be fastened to base plate 112 along the periphery of opening 126 in travelling cover 125. Optionally, and as best seen in FIGS. 3A and 4A, top member 122 of fixed cover 120 may be formed with an upturned lip 122A around the periphery of opening 123, and travelling cover 125 may be formed with a downturned lip 127A around perimeter edge 127, for further protection against entry of contaminants into the inner workings of structural bearing 10.

Persons skilled in the art will appreciate that the protective cover means described and illustrated herein are by way of example only, and that alternative suitable cover means can be readily devised without departing from the principles and concepts of the present invention. Moreover, it is to be understood that protective cover means are not essential to the present invention, and do not form part of the broadest embodiments of the invention.

It will be readily appreciated by those skilled in the art that various modifications of the present invention may be devised without departing from the scope and teaching of the present invention, including modifications which may use equivalent structures or materials hereafter conceived or developed. To provide one particular and non-limiting example, and as previously suggested herein, alternative embodiments can be devised to accommodate lateral displacement either way from a centered or neutral position but only in two opposite directions (e.g., lateral displacement to the north or south, but not to the east or west). Such alternative embodiments would require only one roller bed, disposed between a lower bearing plate and an upper bearing plate. Accordingly, such embodiments would substantially correspond to the illustrated embodiment, but without the middle bearing plate, the upper roller bed, and the third and fourth centering means. For variant assemblies that will not be suspended, and for which no means for preventing vertical separation between the lower and upper bearing plates will be necessary, it may be sufficient to provide only a single centering means.

Another alternative embodiment would accommodate operational conditions where anticipated lateral displacement of one bearing plate relative to another (e.g., lateral displacement of the middle bearing plate relative to the lower bearing plate) would be in one direction only, relative to a centered or neutral position (e.g., lateral displacement to the north but not to the south). In this embodiment, each associated centering means would need only a single compression spring on each side of the assembly.

In a variant combining the two alternative embodiments described immediately above, the principles of the present invention could be applied to accommodate lateral displacement from the neutral position in two opposite directions (e.g., north and south) and only one transverse direction (e.g., east). A further variant would accommodate lateral displacement from the neutral position in only a single direction (e.g., to the north, but not to the east, south, or west); in such embodiments, only a single roller bed would be required, with upper and lower bearing plates.

In yet further alternative embodiments, intended for service conditions in which the auto-centering structural bearing will always be supported from below and will not be suspended, there will be no need for means for preventing vertical separation between adjacent bearing plates, such as lugs 66 on abutments 68 or lugs 104 on abutments 102.

It is to be especially understood that the invention is not intended to be limited to any described or illustrated embodiment, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "mount", "attach", or any other term describing an interaction between elements is not meant to limit the interaction to direct interaction between the subject elements, and may also include indirect interaction between the elements such as through secondary or intermediary structure. Relational terms such as "parallel", "perpendicular", "coincident", "intersecting", and "equidistant" are not intended to denote or require absolute mathematical or geometrical precision. Accordingly, such terms are to be understood as denoting or requiring substantial precision only (e.g., "substantially parallel") unless the context clearly requires otherwise.

What is claimed is:

1. A structural bearing apparatus comprising:

(a) a lower bearing plate having a planar upper surface;

(b) an upper bearing plate having a planar lower surface, said upper bearing plate being positioned such that said planar lower surface is above and parallel to the upper surface of the lower bearing plate;

(c) lateral displacement means comprising roller means, said lateral displacement means being disposed between the lower and upper bearing plates with said roller means in direct rollable contact with the planar upper surface of the lower bearing plate and with the planar lower surface of the upper upper bearing plate, whereby when the upper bearing plate is subjected to a lateral load acting in a first direction:

c.1 the lateral load will cause a lateral displacement of the upper bearing plate in the first direction, relative to the lateral displacement means, and a lateral displacement of the lateral displacement means in the first direction, relative to the lower bearing plate; and c.2 any downward vertical load acting on the upper bearing plate will be transferred through the lateral displacement means to the lower bearing plate; and (d) centering means, for returning the upper bearing plate and the first lateral displacement means to their neutral positions upon removal of the lateral load.

2. A structural bearing apparatus as in claim 1 wherein the lateral displacement means comprises a roller bed including said roller means.

3. A structural bearing apparatus as in claim 2 wherein the roller bed comprises a frame having a pair of spaced-apart side members, and wherein the roller means comprises a plurality of elongate rollers extending between and rotatably mounted in parallel to said side members.

4. A structural bearing apparatus as in claim 2 wherein the roller bed comprises a frame having a pair of spaced-apart side members, and wherein the roller means comprises a plurality of rollers rotatably mounted onto parallel axles extending between and mounted to said side members.

5. A structural bearing apparatus as in claim 2 wherein the roller bed comprises a frame, and wherein the roller means comprises a plurality of ball bearings retained within the frame.

6. A structural bearing apparatus as in claim 2, wherein the centering means comprises:

(a) first spring means associated with the lower bearing plate; and (b) first lug means associated with the roller bed;

such that lateral displacement of the roller bed in a first direction will cause said first lug means to compress said first spring means.

7. A structural bearing apparatus as in claim 6 wherein:

(a) the first spring means comprises a first helical spring on each side of the roller bed, with each first helical spring being carried on a first rod extending between spaced abutments mounted to the lower bearing plate;

(b) the first lug means comprises a pair of first lug members extending outward from opposite sides of the roller frame, with each first lug member having an opening; and (c) each first rod passes through the opening of the corresponding first lug member, such that the corresponding first helical spring will be compressed between said first lug member and one of the abutments mounted to the lower bearing plate when the roller frame is laterally displaced in a first direction relative to the lower bearing plate.

8. A structural bearing apparatus as in claim 7, further comprising a second helical spring carried by each first rod on the side of the corresponding first lug member opposite from the corresponding first helical spring.

9. A structural bearing apparatus as in claim 6 wherein the centering means further comprises:

(a) second spring means associated with the upper bearing plate; and (b) second lug means associated with the lower bearing plate;

such that lateral displacement of the upper bearing plate in a direction opposite to the first direction will cause said second lug means to compress said second spring means.

10. A structural bearing apparatus as in claim 9 wherein:

(a) the second spring means comprises a third helical spring on each side of the roller bed, with each third helical spring being carried on a second rod extending between spaced abutments mounted to the upper bearing plate;

(b) the lug means comprises a pair of second lug members mounted to the lower bearing plate, with each second lug member having an opening; and (c) each second rod passes through the opening of the corresponding second lug member, such that the corresponding second helical spring will be compressed between said second lug member and one of the abutments mounted to the upper bearing plate when the upper bearing plate is laterally displaced in the first direction relative to the lower bearing plate.

11. A structural bearing apparatus as in claim 10, further comprising a fourth helical spring carried by each second rod on the side of the corresponding second lug member opposite from the corresponding third helical spring.

12. A structural bearing apparatus as in claim 6 wherein the centering means further comprises:

(a) second spring means associated with the upper bearing plate; and (b) second lug means associated with the lower bearing plate;

such that lateral displacement of the upper bearing plate in a direction opposite to the first direction will cause said second lug means to elongate said second spring means.

13. A structural bearing apparatus as in claim 2, wherein the centering means comprises:

(a) first spring means associated with the lower bearing plate; and (b) first lug means associated with the roller bed;

such that lateral displacement of the roller bed in a first direction will cause said first lug means to elongate said first spring means.

* * * * *